US008378764B2

(12) United States Patent
Suzuki et al.

(10) Patent No.: US 8,378,764 B2
(45) Date of Patent: Feb. 19, 2013

(54) LEAKY COAXIAL CABLE

(75) Inventors: Fumio Suzuki, Sammu (JP); Kazuhiko Takano, Sakura (JP); Nobunao Ishii, Kamagaya (JP); Junjii Kumada, Machida (JP); Yasuki Ozaki, Tokorozawa (JP); Yoshihiko Nasu, Yokohama (JP); Kazuhisa Satou, Kawasaki (JP)

(73) Assignees: Fujikura Ltd., Tokyo (JP); NHK Integrated Technology Inc., Tokyo (JP)

( * ) Notice: Subject to any disclaimer, the term of this patent is extended or adjusted under 35 U.S.C. 154(b) by 439 days.

(21) Appl. No.: 12/514,260

(22) PCT Filed: Dec. 28, 2007

(86) PCT No.: PCT/JP2007/075328

§ 371 (c)(1),
(2), (4) Date: May 8, 2009

(87) PCT Pub. No.: WO2008/084746

PCT Pub. Date: Jul. 17, 2008

(65) Prior Publication Data

US 2010/0001817 A1 Jan. 7, 2010

(30) Foreign Application Priority Data

Dec. 28, 2006 (JP) ..... 2006-356658

(51) Int. Cl.
*H01Q 13/20* (2006.01)

(52) U.S. Cl. ..... 333/237; 343/770

(58) Field of Classification Search ..... 333/237; 343/770

See application file for complete search history.

(56) References Cited

U.S. PATENT DOCUMENTS

| | | | | |
|---|---|---|---|---|
| 3,795,915 | A * | 3/1974 | Yoshida | 343/771 |
| 3,963,999 | A * | 6/1976 | Nakajima et al. | 333/237 |
| 4,084,141 | A * | 4/1978 | Miyamoto | 333/237 |
| 5,705,967 | A * | 1/1998 | Pirard | 333/237 |
| 6,292,072 | B1 | 9/2001 | Bode et al. | |
| 6,480,163 | B1 * | 11/2002 | Knop et al. | 343/770 |

FOREIGN PATENT DOCUMENTS

| | | | |
|---|---|---|---|
| JP | 05-121926 | A | 5/1993 |
| JP | 06-069720 | A | 3/1994 |
| JP | 07-131236 | A | 5/1995 |
| JP | 09-035547 | A | 2/1997 |
| JP | 09-083243 | A | 3/1997 |
| JP | 10-145136 | A | 5/1998 |
| JP | 10-276037 | A | 10/1998 |
| JP | 2000-068733 | A | 3/2000 |
| JP | 2003-168330 | A | 6/2003 |
| JP | 2003-273641 | A | 9/2003 |

OTHER PUBLICATIONS

Communication dated Feb. 16, 2012 issued by the State Intellectual Property Office of P.R. China in Chinese Application No. 200780048436.6.

Chinese Office Action issued in Chinese Application No. 200780048436.6 dated Aug. 1, 2012.

* cited by examiner

*Primary Examiner* — Benny Lee
(74) *Attorney, Agent, or Firm* — Sughrue Mion, PLLC

(57) ABSTRACT

Provided is a leaky coaxial cable in which a plurality of slots 1 for forming a leak electromagnetic field are arranged in a string shape in an outer conductor of the coaxial cable. The pitch interval of the slots 1 is periodically changed in the axial direction. The periodical change of the pitch interval of a slot portion changes according to a sinusoidal function, a quadratic function, or other functions.

5 Claims, 11 Drawing Sheets

ARRANGEMENT OF LEAK SLOTS AND DEFLECTING CURRENTS

CALCULATION OF RADIATION ELECTRIC FIELD STRENGTH

CALCULATION OF CABLE REFLECTION WAVE

REFLECTION COEFFICIENT OF POINT OF LEAKAGE

DEFLECTING CURRENT EFFECTIVE LENGTH

STRUCTURE OF ACTUALLY MEASURED CABLE

REFERENCE SYSTEM CURRENT DIVISION SYSTEM

CONSIDERATION OF RADIATION POWER (a) CASE OF IDENTICALLY INCLINED SLOTS (b) CASE OF INVERSELY INCLINED SLOTS

ARRANGEMENT OF MULTIPLE SLOTS

VSWR FREQUENCY CHARACTERISTIC OF LCX HAVING EVEN PITCH INTERVAL OF SLOT UNITS

ELECTRIC FIELD DISTRIBUTION (dBV/m) IN POSITIONS AT HEIGHT OF 1.5 m, FREQUENCY f = 260MHz, LCX LOCATED AT DISTANCE OF 0 m AT HEIGHT OF 1.5 m.

ELECTRIC FIELD DISTRIBUTION AROUND LCX HAVING EVEN PITCH INTERVAL OF SLOT UNITS

VSWR FREQUENCY CHARACTERISTIC OF LCX HAVING SINUSOIDALLY CHANGED PITCH INTERVAL OF SLOT UNITS

ELECTRIC FIELD DISTRIBUTION (dBV/m) IN POSITIONS AT HEIGHT OF 1.5 m, FREQUENCY f = 260MHz, LCX LOCATED AT DISTANCE OF 0 m AT HEIGHT OF 1.5 m.

ELECTRIC FIELD DISTRIBUTION AROUND LCX HAVING SINUSOIDALLY CHANGED PITCH INTERVAL OF SLOT UNITS

VSWR FREQUENCY CHARACTERISTIC OF LCX HAVING QUADRATICALLY CHANGED PITCH INTERVAL OF SLOT UNITS

ELECTRIC FIELD DISTRIBUTION (dBV/m) IN POSITIONS AT HEIGHT OF 1.5 m, FREQUENCY f = 260MHz, LCX LOCATED AT DISTANCE OF 0 m AT HEIGHT OF 1.5 m.

ELECTRIC FIELD DISTRIBUTION AROUND LCX HAVING QUADRATICALLY CHANGED PITCH INTERVAL OF SLOT UNITS

LEAKY COAXIAL CABLE

TECHNICAL FIELD

The present invention relates to a leaky coaxial cable, or more specifically to achieving a broadband leaky coaxial cable.

BACKGROUND ART

A leaky coaxial cable (hereinafter referred to as "LCX") includes an inner conductor, an insulator, an outer conductor, and an outer sheath, and has heretofore been installed along the Shinkansen tracks (high speed railway line in Japan) and used for radio communications between trains and a ground terminal, or has been installed on subway premises or underground malls and used for fire or police radio communications with ground terminal as disclosed in Patent Document 1 to Patent Document 8. This LCX is provided with periodic slots in the outer conductor in order to leak electromagnetic energy from an inside of the coaxial cable to the outside of the cable.

Specifically, the outer conductor of the leaky coaxial cable is provided cyclically with multiple elongated-hole shaped slots for each constant cycle along a cable axis. Each of the slots is inclined by a certain angle relative to the cable axis. A leak electromagnetic field is formed by the leaky coaxial cable having the periodical slot arrays. Electric field components in a periaxial (near or around an axis) direction of the leak electromagnetic field can be approximately analyzed by approximating the slot arrays to magnetic current sources distributed on the axis in the axial direction, and then by calculating electromagnetic field formed by these magnetic current sources.

Here, in the LCX, when a pitch interval of the slot units coincides with a wavelength of an operating frequency, a resonant state is established. Accordingly, there is a problem that the operation of the LCX becomes compromised because part of electric power inputted to the LCX returns to a transmitter side, which makes it difficult to achieve broadband capability.

Patent Document 1: JP-A 5-121926
Patent Document 2: JP-A 6-69720
Patent Document 3: JP-A 7-131236
Patent Document 4: JP-A 9-83243
Patent Document 5: JP-A 9-35547
Patent Document 6: JP-A 10-145136
Patent Document 7: JP-A 10-276037
Patent Document 8: JP-A 2003-273641

SUMMARY OF THE INVENTION

As described above, in the conventional LCX, the slots (the elongated holes) are provided periodically in the outer conductor in order to leak the electromagnetic energy inside the coaxial cable (a space between a central conductor and the outer conductor) to the outside of the outer conductor. The resonant state is established when the pitch interval of the slot units coincides with the wavelength of the operating frequency or an integral multiple of the wavelength. This frequency is called a resonant frequency. At this resonant frequency, the LCX exhibit reduced performance because part of the electric power inputted to the LCX returns to the transmitter side. This has been a reason to limit the broadband use of the LCX.

Accordingly, the present invention has been proposed in view of the above-described circumstances and an object thereof is to broaden a frequency band usable by an LCX.

A leaky coaxial cable according to the present invention has any one of the following configurations.

(Configuration 1)

There is provided a leaky coaxial cable including multiple slot portions for forming a leak electromagnetic field, the plurality of slot portions being arranged in an array in an outer conductor of the coaxial cable, characterized in that a pitch interval of the slot portions is periodically changed in an axial direction.

In the leaky coaxial cable according to the present invention, minute reflections from the slot portions are not accumulated. Hence it is possible to expand the usable frequency band.

(Configuration 2)

There is provided the leaky coaxial cable having the configuration 1, which is characterized in that the pitch interval of the slot portions is changed in accordance with a sine function.

In the leaky coaxial cable according to the present invention, a phenomenon that extremely deteriorates a VSWR (voltage standing wave ratio) is eliminated by changing the pitch interval of the slot portions sinusoidally and it is possible to achieve low and dispersed values. Hence it is possible to use the cable up to a high frequency.

(Configuration 3)

There is provided the leaky coaxial cable having the configuration 1, which is characterized in that the pitch interval of the slot portions is changed in accordance with a quadratic function.

In the leaky coaxial cable according to the present invention, the phenomenon that extremely deteriorates the VSWR (voltage standing wave ratio) is eliminated by changing the pitch interval of the slot portions quadratically and it is possible to achieve low and dispersed values. Hence it is possible to use the cable up to a high frequency.

(Configuration 4)

There is provided the leaky coaxial cable having any one of the configurations 1 to 3, which is characterized in that the slot portions, which form multiple slot sequences in the outer conductor, are provided on the opposite sides of a cable axis from each other, and have their directions of inclination aligned with one another.

This leaky coaxial cable can increase radiation power.

(Configuration 5)

There is provided the leaky coaxial cable having any one of the configurations 1 to 4, which is characterized in that each of the slot portions provided in the outer conductor includes numerous small slots equivalent to a large slot.

This leaky coaxial cable allows radiation power to increase, and also makes it possible to suppress deterioration in mechanical strength as compared to the case where large slots are provided.

In the leaky coaxial cable according to the present invention having the configuration 1, an effect of reflection at a resonance point is reduced by periodically changing the pitch interval of the slot portions, whereby minute reflection from the slot portions is not accumulated. Therefore, it is possible to expand the usable frequency band.

In the leaky coaxial cable according to the present invention having the configuration 2, it is possible to drastically reduce the accumulation of minute reflections from the slot portions by periodically changing the pitch of the slot portions in accordance with the sine function, and thereby to expand the usable frequency band.

In the leaky coaxial cable according to the present invention having the configuration 3, it is possible to drastically reduce the accumulation of minute reflections from the slot portions by periodically changing the pitch of the slot portions in accordance with the quadratic function, and thereby to expand the usable frequency band.

Meanwhile, in the leaky coaxial cable according to the present invention, it is possible to control a radiated electric field in the cable direction. Hence it is possible to cover both of a wide space and a narrow space along the cable with the single cable.

Here, it is possible to appropriately select the function in accordance with which the pitch interval of the slots is changed.

In the leaky coaxial cable according to the present invention having the configuration 4, it is possible to increase the radiation power by providing the multiple slot sequences in the outer conductor on the opposite sides of the cable axis from each other and by aligning the directions of inclination.

In the leaky coaxial cable according to the present invention having the configuration 5, each of the slot portions provided in the outer conductor includes the numerous small slots equivalent to a the large slot. Therefore, it is possible to increase the radiation power. In addition, it is possible to suppress deterioration in the mechanical strength as compared to the case where large slots are provided.

BEST MODES FOR CARRYING OUT THE INVENTION

Now, best modes for carrying out the present invention will be described with reference to the drawings.

(A) Deflecting Current Model

In a coaxial cable without slots, a current flowing through an outer conductor and a current flowing through a central conductor of the coaxial cable have the same value but flow in opposite directions. As a result, magnetic field components attributable to the respective currents cancel each other and no magnetic field leaks out of the cable.

Figure 1:
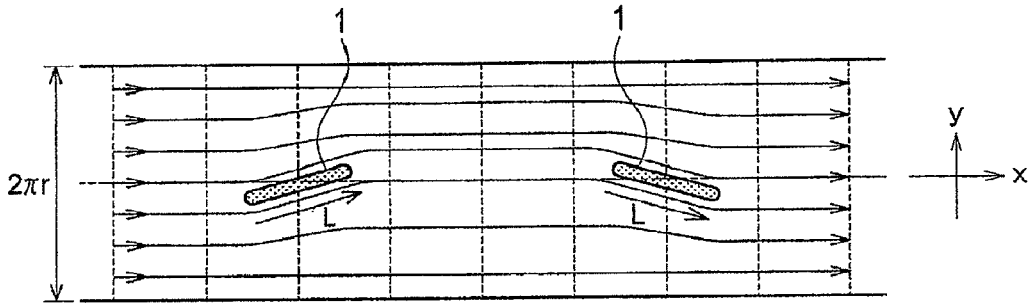
FIG. 1 is a side view showing a relation between leak slot arrangement and a deflecting current in a coaxial cable.

FIG. 1 is a side view showing a relation between leak slot arrangement and a deflecting current in the coaxial cable. As shown in FIG. 1, $2\pi r$ represents the outer circumference of the cable.

Meanwhile, when slots 1 having a length L (x-direction) are arranged in an outer conductor as shown in FIG. 1, a current flowing through the outer conductor deflects in the vicinity of the slot 1 whereby a current component Iy in a circumferential direction (y) is generated (Note; r is the radius of the cable). Since a current canceling a magnetic field component generated by this Iy does not exist on a central conductor side, this magnetic field will leak out of the cable. An electromagnetic wave is radiated when this magnetic field varies temporally. In this way, a characteristic of a leaky coaxial cable (hereinafter referred to as a "LCX") is calculated by using a model in which the deflection of the current flowing through the outer conductor causes the radiation. Note that, in the following description, the slot means a hole while a slot unit means a set of slots existing in one slot pitch.

The circumferential direction current component Iy in the vicinity of the slot 1 and the magnetic field component Hx related thereto are:

$$I_y = C_i \cdot I_o \sin\theta, \tag{1.1}$$

$$H_x = C_h \cdot I_o \sin\theta, \tag{1.2}$$

where $I_o$ is the current flowing along the slot, θ is an angle of the slot relative to the cable axial direction, and $C_i$ and $C_h$ are proportional constants. Meanwhile, the axial direction current component Ix in the vicinity of the slot and the magnetic field component Hy are:

$$I_x = C_i \cdot I_o \cos\theta, \tag{1.3}$$

$$H_y = C_h \cdot I_o \cos\theta. \tag{1.4}$$

From Formula (1.2) and Formula (1.4), the magnetic field component H that leaks out without being cancelled becomes:

$$H = \sqrt{H_x^2 + (H_y - H_o)^2} = C_h \cdot I_o \sqrt{2 - 2\cos\theta} = 2C_h I_o \sin(\theta/2), \tag{1.5}$$

where Ho is a magnetic field component in the circumferential direction, which is generated in the vicinity of the slot by the central conductor. Regarding an outer conductor current corresponding thereto, H in Formula (1.5) is equivalent to the outer conductor current I. The current component (a deflecting current) contributing to this external leakage flows in a range substantially equal to a range of a slot length. Here, assuming the angle θ is small, a distance in the deflecting current direction can be approximated as L sin θ. Therefore, the deflecting current that contributes to the external leakage is deemed to flow just for the distance of L sin θ and the slot 1 is deemed to be equivalent to a current source having an equivalent length of L sin θ located in the circumferential direction. Here, the direction ϕ of an equivalent deflecting current is calculated as described below, which is slightly different from the circumferential direction:

$$\phi=\arctan(\sin\theta/(\cos\theta-1))=\pi/2+\theta/2. \quad (1.6)$$

(B) Calculation of Radiation Electric Field

An assumption will be made in accordance with the above-described deflecting current model in (1) that each of the slots 1 is provided with the current source.

Figure 2:
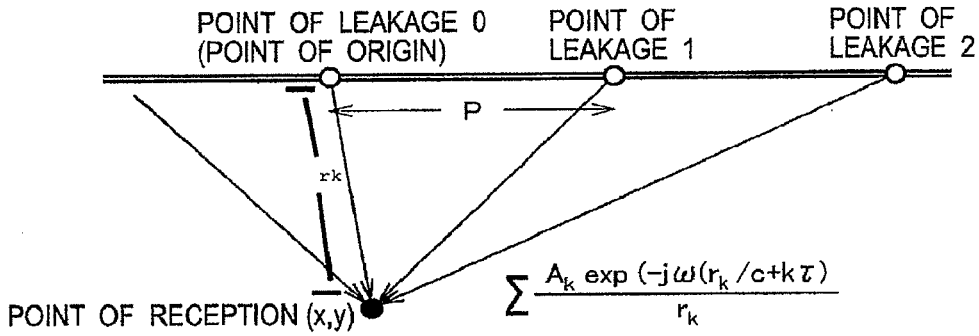
FIG. 2 is a diagram showing calculation of radiation electric field strength.

FIG. 2 is a diagram showing calculation of radiation electric field strength from point of origin including points of leakage 0, 1 and 2.

Each current source can be deemed as a point wave source along the axial direction. As shown in FIG. 2, received electric field strength (FS) is obtained by complex combination of radiation waves from those sources at a point of reception:

$$FS=(\sqrt{30}\sqrt{Pt})\cdot\sum_k A_k\frac{\exp(-j\omega(r_k/c+k\tau)}{r_k}, \quad (1.7)$$

where P is an interval of the slot unit; $r_k$ is a distance from a point of leakage to the point of reception, and is expressed as $r_k=\sqrt{\{(x-kP)^2+y^2\}}$; τ is propagation time of the current that proceeds for one pitch of the slot unit, and is expressed as $\tau=P\sqrt{\in}/c$; c is the speed of light; ∈ is a relative dielectric constant of an insulator in the cable; $A_k$ is a radiation amplitude at a k-th point of leakage; x and y are coordinates of the point of reception; and ω is an angular frequency of the current flowing through the LCX. Meanwhile, $P_t$ is radiation power and √30 is a conversion constant. Here, considering that the electric field strength radiated is inversely proportional to the wavelength (proportional to the frequency) when an antenna equivalent length (an equivalent length of the aforementioned equivalent deflecting current source) is smaller than the wavelength, $A_k$ has the value that is proportional to the frequency.

(C) Calculation of VSWR (Voltage Standing Wave Ratio)

(1) Resonance Frequency

A sum of all reflection waves reflected by the respective slots 1 and returning to a point of transmission will be discussed. When a voltage reflection coefficient at a k-th slot counted from the point of transmission is α, amplitudes of the reflection wave and a transmission wave are expressed by the following formulae:

$$R(k)=|T(k-1)|\alpha exp(-j\omega k\tau) \quad (1.11)$$

$$T(k)=|T(k-1)|\sqrt{1-\alpha^2}exp(-j\omega k\tau), \quad (1.12)$$

where R(k) is a complex amplitude of the wave reflected by the slot, T(k) is a complex amplitude of the transmission wave that passes through the point of leakage and T(K−1) is a complex amplitude of the transmission wave that passes through the point of leakage of a (k−1)th slot. Moreover, the magnitude of T(k) is expressed by the following formula:

$$|T(k)|=\sqrt{(1-\alpha^2)^k}=(1-\alpha^2)^{\frac{k}{2}}. \quad (1.13)$$

Figure 3:
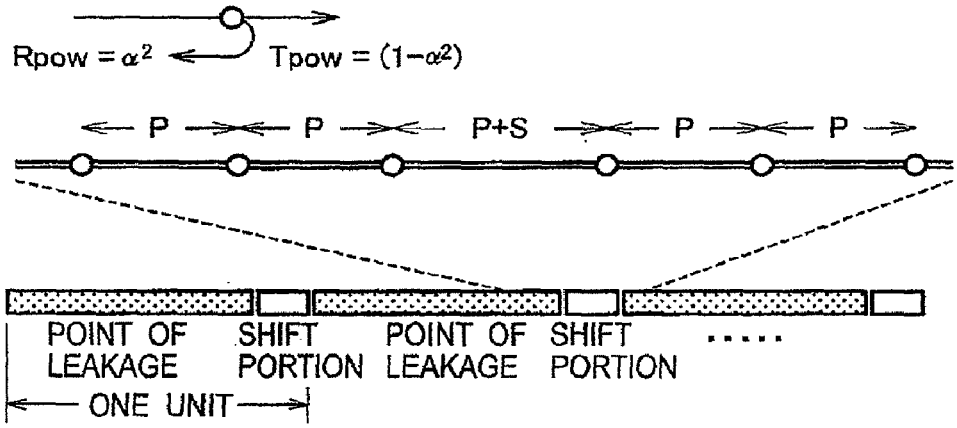
FIG. 3 is a diagram showing calculation of cable reflection wave.

FIG. 3 is a diagram showing calculation of a cable reflection wave. The reflected component is shown as $R_{pow}$ and the transmitted component is shown as $T_{pow}$. α is the voltage reflection coefficient. Wherein P is the point of leakage and P+S is the point of leakage plus a shift distance.

When the reflection wave returns to a transmission end, changes in the amplitude and phase apply in the same manner as provided by Formula (1.11) as shown in FIG. 3. Therefore:

$$S(k)=R(k)^2, \quad (1.14)$$

$$S=\sum_k S(k)=\sum_k(1-\alpha^2)^k\alpha^2\exp(-j2\omega k\tau), \quad (1.15)$$

where S represents a sum of all the reflection waves S(k) returning to the transmission end.

In formula (1.15), there are maximum values at frequencies that satisfy the condition where ωkτ=integer, for all λ. To be more precise, the reflection wave has local maximum at the frequency f, that is, a resonance frequency equal to an integral multiple of:

$$f=\tfrac{1}{2}\tau=c/(2P\sqrt{\in}) \quad (1.16)$$

When multiple radiation amplitudes are cyclically arranged, such a cycle is defined as a basic pitch Pb. The radiation amplitude within the basic pitch is assumed to change by a sine function or the like. In this case, a reflection coefficient is proportional to an absolute value of the radiation coefficient. Accordingly, the cycle of the reflection coefficient is equal to Pb/2. Therefore, the resonance frequency $f_o$ becomes twice as large as Formula (1.16):

$$f_o=c/(P_b\sqrt{\in}). \quad (1.17)$$

(2) Reflection Coefficient

Figure 4:
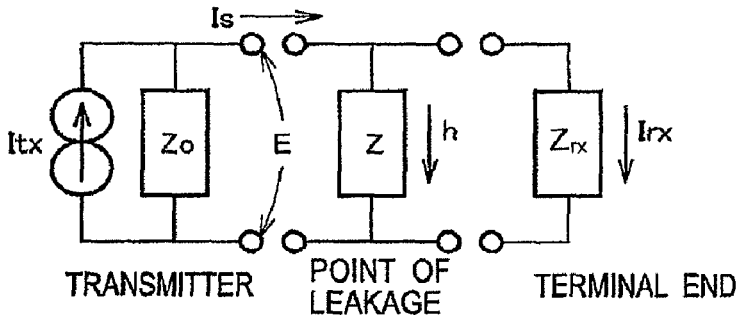
FIG. 4 is an equivalent circuit diagram showing a reflection coefficient at a point of leakage.

FIG. 4 is an equivalent circuit diagram showing the reflection coefficient at the point of leakage.

The deflecting current flows on the slot. Considering a cable having only one slot (i.e., point of leakage), then as shown in FIG. 4, it is possible to express that impedance (z) is connected to the slot and a current (h) corresponding to the deflecting current flows thereon. When a current source of a transmitter is Io (represented as $I_{tx}$ in FIG. 4) and a ratio between the deflecting current (h) and a current ($I_{rx}$) flowing through a terminal end resistor ($Z_o$) is β, the following formula holds true:

$$Io=2Irx+h=(2+\beta)Irx. \quad (1.18)$$

A transmission end voltage at this time can be expressed as:

$$E=Zo\cdot Ir=Zo\frac{Io}{2+\beta}=\frac{Zo\cdot Io}{2}\left(1-\frac{\beta/2}{1+\beta/2}\right)\approx\frac{Zo\cdot Io}{2}(1-\beta/2). \quad (1.19)$$

Meanwhile, without slots, the terminal voltage is $E=Z_o\cdot I_o/2$. When comparing this with Formula (1.19), the terminal voltage is reduced by an amount approximately equal to β/2 in a case where the slot is provided in comparison with the case without the slots, and this amount of reduction can be deemed as a reflection wave component from the slot. That is, the voltage reflection coefficient α is equal to β/2.

Incidentally, terminal end impedance in FIG. 4 is denoted by Zrx and this is changed to obtain slot current Is =Itx/2, namely:

$$Zrx = \frac{1}{1-\beta}Zo \approx (1+\beta)Zo. \tag{1.20}$$

When cable impedance is increased every time of passing the slot in accordance with the above formula, Is in FIG. 4 becomes constant irrespective of the presence or absence of the slot. This is equivalent to non-occurrence of the reflection wave. To realize Formula (1.20), it is possible to consider measures of gradually thinning the central conductor, gradually thickening the outer conductor, reducing the dielectric constant of the insulator, and so forth.

The deflection of an outer conductor current at the position of the slot leads to an extension of the passage of the current flow, and it is thus conceivable that a propagation delay is increased by just that much.

Figure 5:
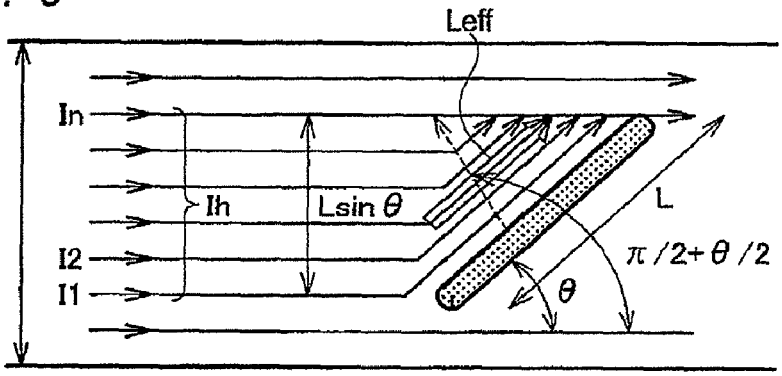
FIG. 5 is a diagram showing a relation between an inclination of the slot and an effective length of the deflecting current.

FIG. 5 is a diagram showing a relation between an inclination of the slot and an effective length Leff of the deflecting current. The deflecting current $I_h$ varies from one close to L to one close to zero. Accordingly, an effective length thereof becomes equal to half of L.

As shown in FIG. 5, a length of a radiation slot is defined as L while an angle thereof is defined as θ. At a portion without radiation slots, the current is assumed to flow evenly in the coaxial outer conductor. The deflecting current ($I_h$) is proportional to a projected length of the slot on circumference relative to a circumferential length of the coaxial outer conductor. Hence, when the entire current is denoted by $I_o$ and r is a radius of the insulator:

$$I_h = I_o \cdot L \sin\theta / 2\pi r. \tag{1.21}$$

Consideration will be made by dividing this current into n portions. Passages of the respective currents ($I_1, I_2, \ldots, I_n$) vary from one close to L ($I_1$) to one close to zero ($I_n$). The passage as the entire $I_h$ is equivalent to an average value of the respective current passages. Accordingly, a passage increase ΔL thereof is:

$$\Delta L = L(1-\cos\theta)/2. \tag{1.22}$$

Here, it is conceivable that the flow of the deflecting current on the left side of the slot means formation of a potential gradient locally in the vertical direction in FIG. 5. By this potential gradient, the deflecting current also flows in the vicinity of the right side of the slot as shown in FIG. 1. As a consequence, the entire deflecting current is conceivably twice as much as Formula (1.21). Since the passage increase of the non-deflected outer conductor current is equal to zero, delay time of the entire outer conductor current associated with the passage increase ΔDL is:

$$\Delta DL = \frac{2I_h}{I_o}\frac{\Delta L}{Vc} = \frac{L\sin\theta}{\pi r}\frac{L(1-\cos\theta)}{2Vc} = \frac{L\sin\theta}{\pi r}\frac{L\sin^2(\theta/2)}{Vc}, \tag{1.23}$$

where Vc=c/√∈ is a propagation speed of the current inside the cable. As for an equivalent circuit to provide the delay expressed by Formula (1.23), the impedance (Z) in FIG. 4 should be replaced by a capacitance (C). A circuit response in this case is:

$$E = \frac{Zo/2}{1+j\omega CZo/2}Itx. \tag{1.24}$$

The delay time becomes equal to a known time constant (=$CZ_0/2$). The values h and β will be found based on the assumption that this delay time is equal to DL in Formula (1.23). Specifically, the following formula is derived from h=jωCE and Irx=E/$Z_o$:

$$\beta = h/Irx = j\omega CZo = j\omega 2DL \therefore \alpha = j\omega\Delta DL \tag{1.25}$$

In this model, the reflection is assumed to occur intensively in the center of the slot. However, in the actual cable, the reflection occurs in a dispersed manner inside one slot. For this reason, it is necessary to consider a phase shift inside the slot. When an apparent reflection coefficient per slot is $\alpha_{mes}$, a relation with α in Formula (1.25) is:

$$\alpha_{mes} = \int_{-L/2}^{L/2}(\delta\alpha)\exp(j2\pi\cdot 2x/\lambda c)dx = L(\delta\alpha)\frac{\sin(2\pi L/\lambda c)}{2\pi L/\lambda c} = \alpha\frac{\sin(2\pi L/\lambda c)}{2\pi L/\lambda c}, \tag{1.26}$$

where λc=λ√∈ is the wavelength of the current inside the cable and x represents a length along the cable and δ represents slot/unit length. For example, $\alpha_{mes}$=0.947α at 220 MHz while $\alpha_{mes}$=0.648α at 600 MHz. The following formula is derived from Formulae (1.25) and (1.26):

$$\alpha_{mes} = j2\omega\frac{L\sin\theta}{\pi r}\frac{L\sin^2(\theta/2)}{Vc}\frac{\sin(2\pi L/\lambda c)}{2\pi L/\lambda c}. \tag{1.27}$$

Here, an accurate value of an integral range in Formula (1.26) is ±(L cos θ)/2. However, to avoid complication of the formula, cos θ is omitted on the assumption that θ is a small angle.

Figure 6:
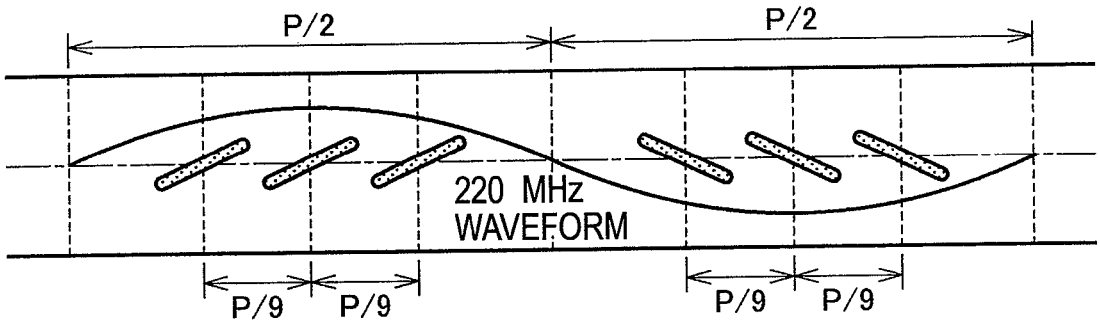
FIG. 6 is a side view showing a structure of an actually measured cable.

FIG. 6 is a side view showing a structure of an actually measured cable. The slot unit of this cable includes 6 slots. Each slot is spaced apart by a distance of ⅓ of the pitch (P).

Whether or not the above-described delay model holds true will be discussed by comparison with an actual cable characteristic. At a resonance frequency of 220 MHz, a wavelength on a reference cable coincides with the basic pitch (P) as shown in FIG. 6. At this time, a reflection coefficient Vr of reflection waves from respective points of leakage for one basic pitch in consideration of the phase shift will be:

$$Vr = \alpha_{mes}(e^{j\phi}+e^{o}+e^{-j\phi}+e^{j\phi-2\pi}+e^{-j}2\pi+e^{-j\phi-2\pi}) = 2.69\times\alpha_{mes}, \tag{1.28}$$

where α is the reflection coefficient of each slot. Since all the slots on the actually measured cable have the same structure, the reflection coefficients of the respective points of leakage become equal. Meanwhile, the phase of the reflection wave is given by $\phi = 2\pi\cdot 2/3$, which is equivalent to the phase shift twice as much as the interval between the respective slots. Similarly, attention should be made that the phase between the slots having a distance of ½ of the wavelength is shifted in an amount of 2π.

The characteristics of the actually measure cable will be shown on the following Table 1.

TABLE 1

| Characteristics of actually measured cable | |
|---|---|
| Wavelength shortening ratio | 0.877 |
| r (Type 43D) | 0.02 m |
| L | 0.14 m |
| θ | 10.5 degrees |
| Basic pitch interval of slot unit | 1.25 m |
| Number of slots/slot unit | 6 pieces |
| Cable length | 50 m |
| VSWR @220 MHz | 2.0 |
| Coupling loss @150 MHz | 58 dB |

Since the actually measured cable has the length of 50 m, about 40 slot units are included, therefore:

$$VSWR = \frac{1+\sum Vr}{1-\sum Vr} = \frac{1+40\times Vr}{1-40\times Vr} = \frac{1+107.6\times\alpha_{mes}}{1-107.6\times\alpha_{mes}}, \quad (1.29)$$

$$\alpha_{mes} = \frac{1}{107.6}\frac{VSWR-1}{VSWR+1} = -50.2 \text{ dB}.$$

Meanwhile, when the structural parameters of the actually measured cable shown in Table 1 are assigned to Formula (1.27), the result will be 52.9 dB. This value is approximately equal to the actually measured value. Therefore, it is possible to say that the above-described delay model holds true.

(D) Radiation Efficiency (1) Calculation of Radiation Efficiency

First, a relation between the radiation power and the current will be considered.

Figure 7:
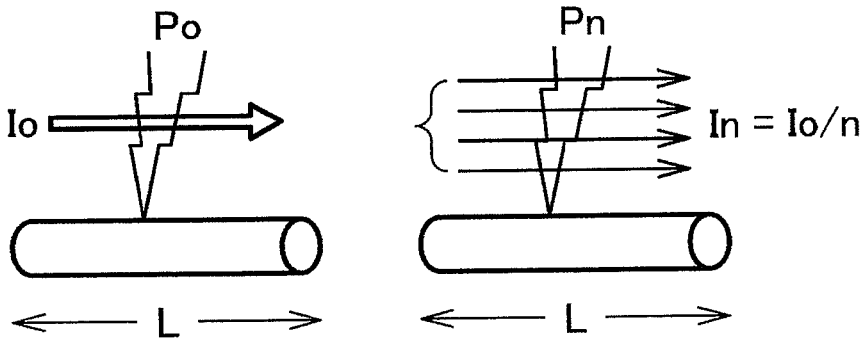
FIG. 7 is a diagram for discussing the radiation power.

FIG. 7 is a diagram for discussing the radiation power (L is the length of the cable).

When the power radiated by the current $I_o$ is defined as $P_o$, the following formula is obtained in consideration of a diagram on the left side (a reference system) in FIG. 7:

$$Po=Io^2Zo \quad (1.30)$$

A diagram on the right side (a current division system) in FIG. 7 shows a case of dividing the current into n pieces. When the divided current is $In=I_o/n$, the power Pn to be radiated by each of the currents is:

$$Pn=\Sigma In^2Zn=n\cdot In^2Zn=n\cdot(Io/n)^2Zn=Io^2(Zn/n). \quad (1.31)$$

Since radiation power is the same in consideration of either of the reference system or the current division system, $P_o$=Pn holds true. Therefore, the following formula is obtained:

$$Zn/n=Zo \therefore Zn=Zo\times n. \quad (1.32)$$

Specifically, in calculation of the radiation power by dividing the current, it is necessary to increase radiation impedance in response to the number of division.

Now, assuming that the number of division of the current flowing through the outer conductor is n:

$$I_k=I_0/n \text{ and } L_k=L(1-k/n). \quad (1.33)$$

Referring to Formula (1.5), an effective deflecting current $Ieq_k$ concerning the radiation is:

$$Ieq_k = 2I_k\sin(\theta/2) = \frac{I_0}{n}\frac{L\sin\theta}{\pi r}\sin(\theta/2). \quad (1.34)$$

Since the direction of the effective deflecting current is equal to π/2+θ/2 according to Formula (1.6), an equivalent length $Leq_k$ in that direction is:

$$Leq_k = \frac{L_k\sin\theta}{\sin(\pi/2+\theta/2)} = \frac{L\sin\theta}{\cos(\theta/2)}(1-k/n). \quad (1.35)$$

That is, it is possible to understand that radiation current $Ieq_k$ in Formula (1.34) flows for a distance of the equivalent length $Leq_k$.

Therefore, in consideration of Formula (1.32), the radiation power $P_k$ by each of the currents is:

$$P_k = Ieq^2\cdot nRr = Ieq_k^2\cdot n80\pi^2(Leq_k/\lambda)^2 = n80\pi^2\left(\frac{IoL\sin\theta}{n\pi r}\sin(\theta/2)\right)^2\left(\frac{L\sin\theta}{\lambda\cos(\theta/2)}(1-k/n)\right)^2 = 80\left(\frac{L\sin\theta}{r}\right)^2\left(\frac{L\sin\theta}{\lambda}\right)^2\tan^2(\theta/2)\frac{(1-k/n)^2}{n}Io^2. \quad (1.36)$$

When the power propagated in the cable is defined as Pt, a sum of the respective radiation power factors $P_{rad}$ is obtained in consideration of $Io^2$=Pt/Zo:

$$P_{rad} = \sum P_k = \frac{80}{3}\left(\frac{L\sin\theta}{r}\right)^2\left(\frac{L\sin\theta}{\lambda}\right)^2\tan^2(\theta/2)\left(\frac{Pt}{Zo}\right), \quad (1.37)$$

$$\eta = \frac{80}{3Zo}\left(\frac{L\sin\theta}{r}\right)^2\left(\frac{L\sin\theta}{\lambda}\right)^2\tan^2(\theta/2).$$

In Formula (1.37), the slot is assumed to have an infinitesimal size. The radiation efficiency η is also as shown above. However, in a slot having a finite length, it is necessary to consider the phase of the wave radiated from each minute portion inside the slot. Based on phase of the radiation wave in the center of the slot as a reference, a phase difference at each minute portion is 2πx/λ. Accordingly, average amplitude A of the entire slot is:

$$A = \int_{-L/2}^{L/2}\exp(j2\pi x/\lambda) = L\frac{\sin(\pi L/\lambda)}{\pi L/\lambda}. \quad (1.38)$$

In consideration thereof, radiation efficiency η is modified as:

$$\eta = \text{Formula (1.37)}\times(A/L)^2 = \frac{80}{3Zo}\left(\frac{L\sin\theta}{r}\right)^2\left(\frac{L\sin\theta}{\lambda}\right)^2\tan^2(\theta/2)\frac{\sin(\pi L/\lambda)}{\pi L/\lambda}. \quad (1.39$$

In the case of the actually measured cable, this correction is around 1 dB at 600 MHz.

Moreover, the deflecting current on the right side of the slot discussed in the derivation of Formula (1.24) also performs radio emission in accordance with Formula (1.39). Accord ingly, the entire radiation efficiency η becomes twice as much as Formula (1.39) and can be calculated as follows:

$$\eta = \text{Formula (1.39)} \times 2 = \frac{160}{3Zo}\left(\frac{L\sin\theta}{r}\right)^2\left(\frac{L\sin\theta}{\lambda}\right)^2\tan^2(\theta/2)\left(\frac{\sin(\pi L/\lambda c)}{\pi L/\lambda}\right)^2. \quad (1.40)$$

(2) Increase in Radiation Efficiency (Arrangement of Multiple Slots)

Next, arrangement of multiple slots in the same position relative to the cable direction will be considered as a configuration to increase the radiation efficiency.

Figure 8:
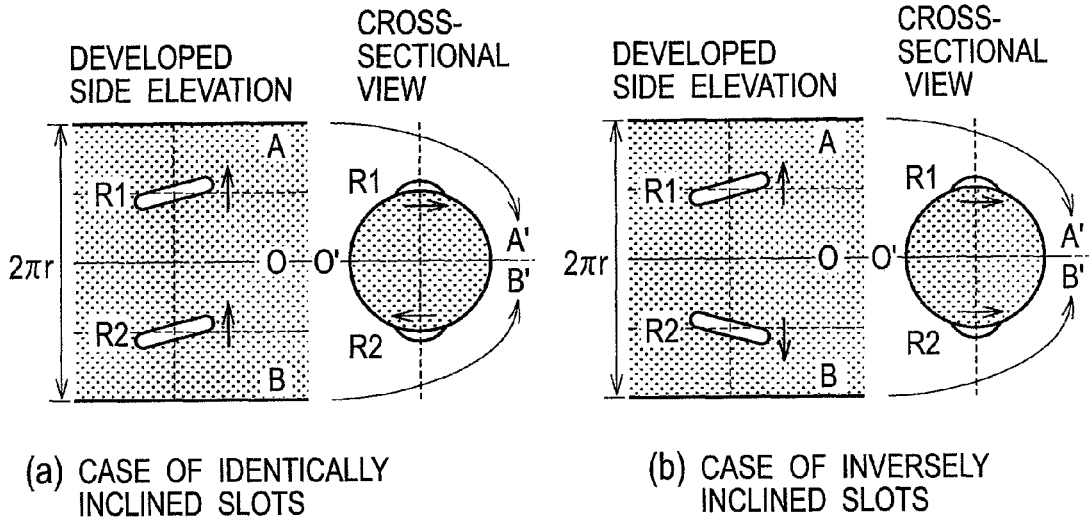
FIG. 8 is a diagram showing a case of arranging two slots.

FIG. 8 is a diagram showing a case of arranging two slots. The developed side elevation represents the whole outer surface of the cable. Points A and B in the developed side elevation correspond to points A' and B' in the cross-sectional view.

When the directions of inclination of the slots are set the same, the deflecting currents of the respective slots R1, R2 are oriented in the mutually opposite directions as shown in part (a) of FIG. 8. Accordingly, the deflecting currents are cancelled as a whole. Therefore, as shown in part (b) of FIG. 8, it is preferable to set up the directions of inclination of the slots R1, R2 in the mutually opposite directions. Here, arrows in the drawing indicate the directions of inclination of the slots in which an arrow ↑ indicates a diagonally right up direction while an arrow ↓ indicates a diagonally right down direction.

Figure 9:
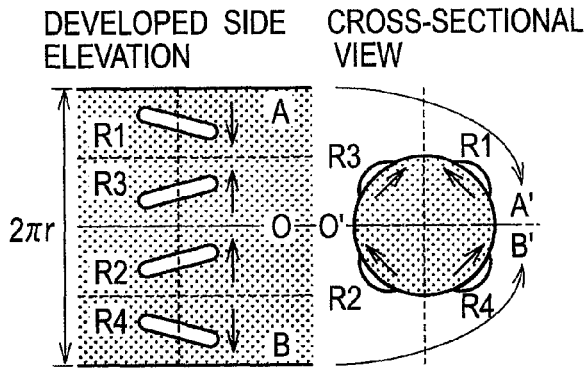
FIG. 9 is a diagram showing a case of arranging four slots.

FIG. 9 is a diagram showing a case of arranging four slots. The developed side elevation represents the whole outer surface of the cable. Points A and B in the developed side elevation correspond to points A' and B' in the cross-sectional view. Here, arrows in the drawing indicate the directions of inclination of the slots in which an arrow ↑ indicates a diagonally right up direction while an arrow ↓ indicates a diagonally right down direction.

Moreover, in order to improve the radiation efficiency, the four slots R1, R2, R3 and R4 are arranged as shown in FIG. 9 so as to render the respective deflecting currents orthogonal to one another. In this case, there is no interference between the currents that are orthogonal to each other. However, the respective deflecting currents are not rendered orthogonal to one another if the number of the slots is increased further, thereby causing the interference among the currents. As a consequence, it is no longer possible to obtain the increase in the radiation efficiency reflecting the increase in the number of slots.

Figure 10:
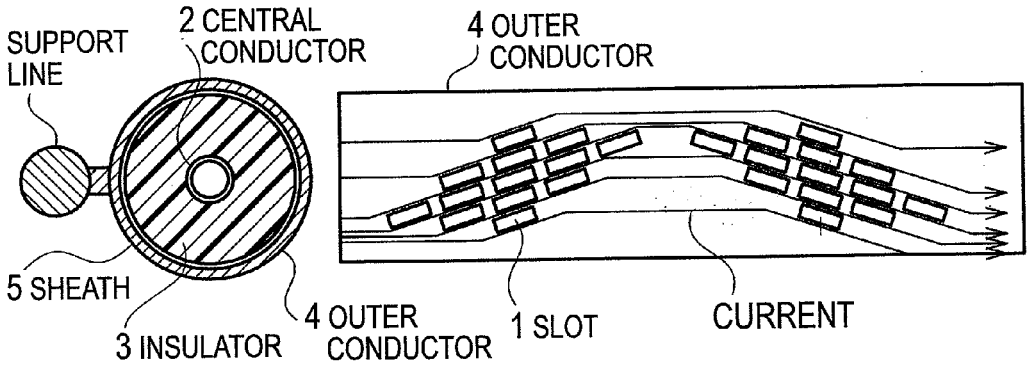
FIG. 10 shows a cross-sectional view and a side view indicating a concrete configuration of an LCX provided with numerous slots equivalent to large slots.

FIG. 10 shows a cross-sectional view and a side view indicating a concrete configuration of an LCX in which numerous small slots equivalent to large slots are provided in an outer conductor. In this embodiment, the number of small slots is set in a range from several slots to several tens of slots. However, ideally, it is preferable to reduce the size of the small slots as small as possible and to provide as many of them as possible. FIG. 10 shows the effects of the slot configuration on the current flowing through the LCX.

As shown in FIG. 10, this LCX includes a central conductor 2, an insulator 3, an outer conductor 4, a support line and an outside coating (a sheath) 5. As described previously, the outer conductor 4 is provided with multiple slots 1.

(E) Concrete Structure of Slot Unit

Figure 11:
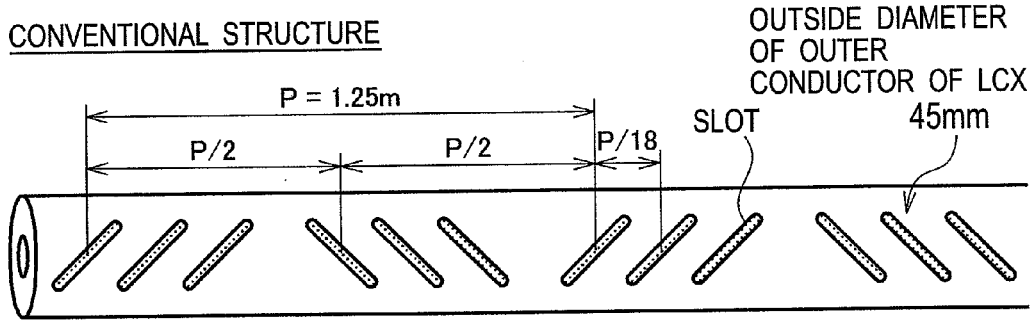
FIG. 11 is a side view schematically showing slot arrangement in a conventional LCX.

FIG. 11 is a side view schematically showing slot unit arrangement in a conventional LCX. There are 6 slots in a slot unit (of pitch P) of this cable with the spacing between adjacent slots being P/18.

Figure 12:
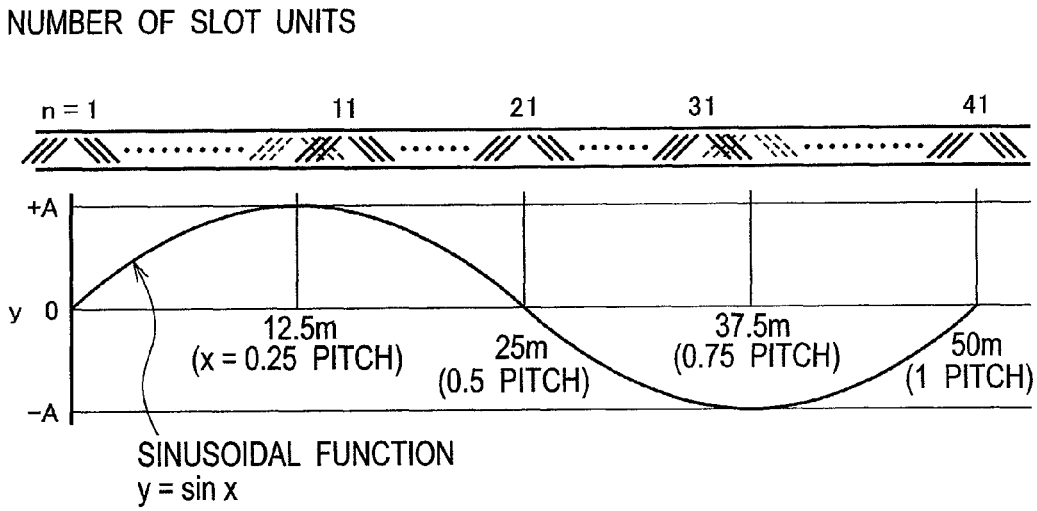
FIG. 12 is a side view showing a configuration of an LCX according to the present invention in which a pitch interval of slot units is sinusoidally changed.

FIG. 12 is a side view showing a configuration of an LCX according to the present invention in which a pitch interval of slot units is sinusoidally changed according to the sinusoidal equation y=sin x. The amplitude of the sine curve is represented by A+ and A−. There are 6 slots in a slot unit of this cable.

In this FIG. 12, slot units indicated with dotted lines show positions of the slot units in the conventional LCX. Specifically, in the conventional LCX, the arrangement of the slot units is rendered even, without cyclical changes of the intervals as shown in FIG. 11.

In the LCX according to the present invention, the following features appear as shown in FIG. 12 by sinusoidally changing the pitch interval of the slot units. This is shown with respect the each respective number of slot units (n), where n is 1, 11, 21, 31 and 41 in the figure. The variable x represents a length along the cable from a reference from reference point 0.

(1) A pitch of a sine wave is 50 m. The pitch interval of the slot units is initially 1.25 m and is gradually increased in accordance with a sine function. A position of an eleventh slot unit is located in a position at 12.9 m, which is 0.4 m ahead of a position at 12.5 m in the case of the even pitch interval. A positional difference from the case of the even pitch interval coincides with amplitude of the sine wave y=sin x. After 0.25 pitch of the sine wave, the pitch interval of the slot units is gradually decreased. A position of a twenty-first slot unit (0.5 pitch of the sine wave) is located in a position at 25 m, which is the same position as the case of the even pitch interval.

(2) The pitch of the slot units is gradually decreased after passing 0.5 pitch of the sine wave. A position of a thirty-first slot unit is located in a position at a 37.1 m, which is 0.4 m behind a position at 37.5 m in the case of the even pitch interval. Here, a positional difference from the case of the even pitch interval also coincides with amplitude of the sine wave y=sin x. After 0.75 pitch of the sine wave, the pitch interval of the slot units is gradually increased. A position of a forty-first slot unit is located in a position at 50 m, which is the same position as the case of the even pitch interval.

Figure 13:
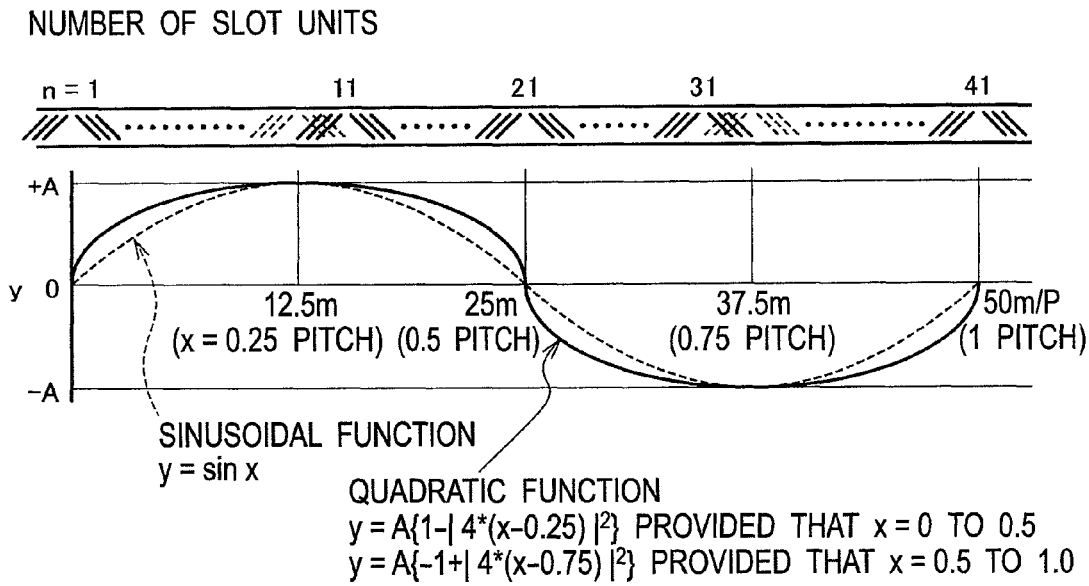
FIG. 13 is a side view showing a configuration of an LCX according to the present invention in which a pitch interval of slot units is quadratically changed.

FIG. 13 is a side view showing a configuration of the LCX according to the present invention in which the pitch interval of the slot units is quadratically changed. The amplitude of the quadratic equation represented by A+ and A−.

In the LCX according to the present invention, the following features appear as shown in FIG. 13 by quadratically changing the pitch interval of the slot units. This is shown with respect the each respective number of slot units (n), where n is 1, 11, 21, 31 and 41 in the figure. The variable x represents a length along the cable from a reference from reference point 0.

(1) A pitch of a quadratic function is equal to 50 m. The pitch interval of the slot units is initially 1.25 m and is gradually increased in accordance with a quadratic function. A position of an eleventh slot unit is located in a position at 12.9 m, which is 0.4 m ahead of a position at 12.5 m in the case of the even pitch interval. A positional difference from the case of the even pitch interval coincides with amplitude of the quadratic function $y=A\{1-|4\cdot(x-0.25)|^2\}$ shown in FIG. 13. After 0.25 pitch of the sine wave, the pitch interval of the slot units is gradually decreased. A position of a twenty-first slot unit (0.5 pitch of the sine wave) is located in a position at 25 m, which is the same position as the case of the even pitch interval.

(2) The pitch interval of the slot units is gradually decreased after passing 0.5 pitch of the quadratic function. A position of a thirty-first slot unit is located in a position at 37.1 m, which is 0.4 m behind a position at 37.5 m in the case of the even pitch interval. Here, a positional difference from the case of the conventional pitch interval also coincides with amplitude of the quadratic function $y=A\{-1+|4\cdot(x-0.75)|^2\}$. After 0.75 pitch of the sine wave, the pitch interval of the slot units is gradually increased. A position of a forty-first slot unit is located in a position at 50 m, which is the same position as the case of the even pitch interval.

Embodiment 1

(1) Case of Conventional Design

Figure 14:
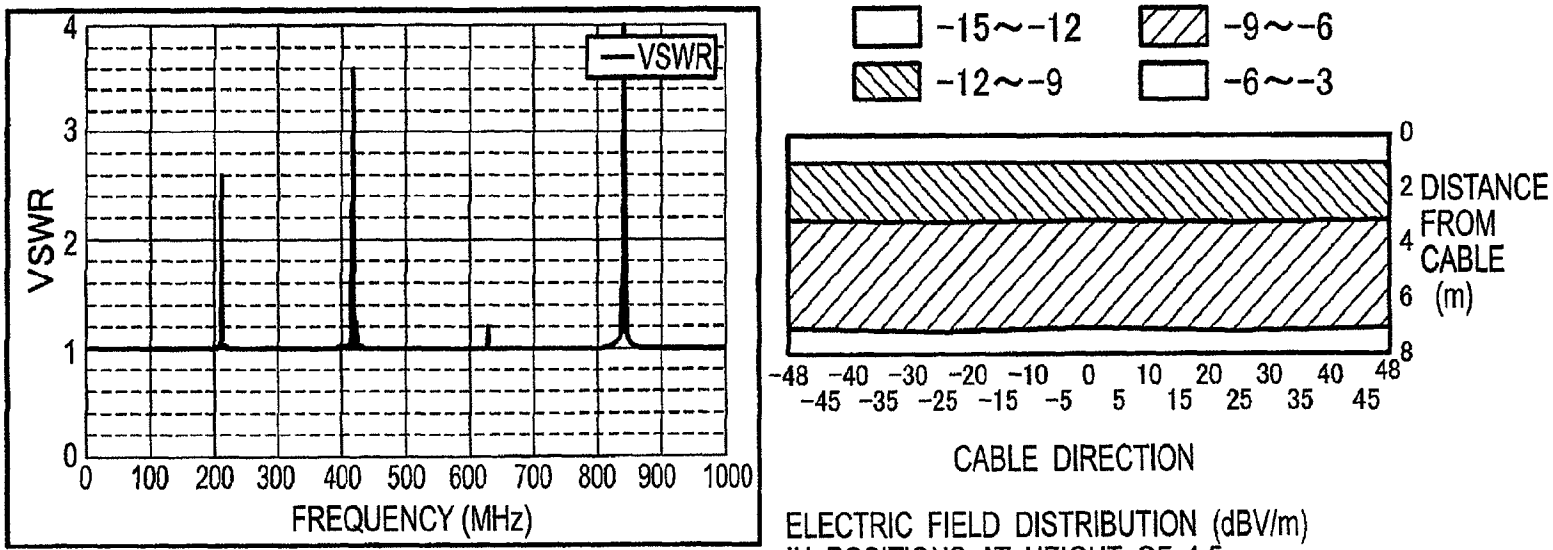
FIG. 14 CONVENTIONAL ART
FIG. 14 is a graph showing a frequency characteristic of a VSWR of the conventional LCX.

FIG. 14 is a graph showing a frequency characteristic of the VSWR of the conventional LCX.

FIG. 14 is obtained by calculating the VSWR based on this method in terms of the conventional structure shown in (Table 2) below, i.e. the LCX having the even pitch interval of the slot units.

TABLE 2

| LCX structure according to conventional design | |
|---|---|
| Outer diameter of central conductor | 17 mm |
| Outer diameter of insulator | 42 mm |
| Outer diameter of outer conductor | 45 mm |
| Outer diameter of sheath | 48 mm |
| Pitch interval of slot units | 1.25 m |
| Cable length | 200 m |

The reason for deterioration of the VSWR at the frequency near 210 MHz is attributable to the resonance point on the slot cycle which can be calculated by use of Formula (1.17). Meanwhile, the resonance points appear in positions corresponding to the integral multiples. At this frequency, most of incident power onto the LCX returns to the transmission side and the LCX is therefore unusable.

Figure 17:
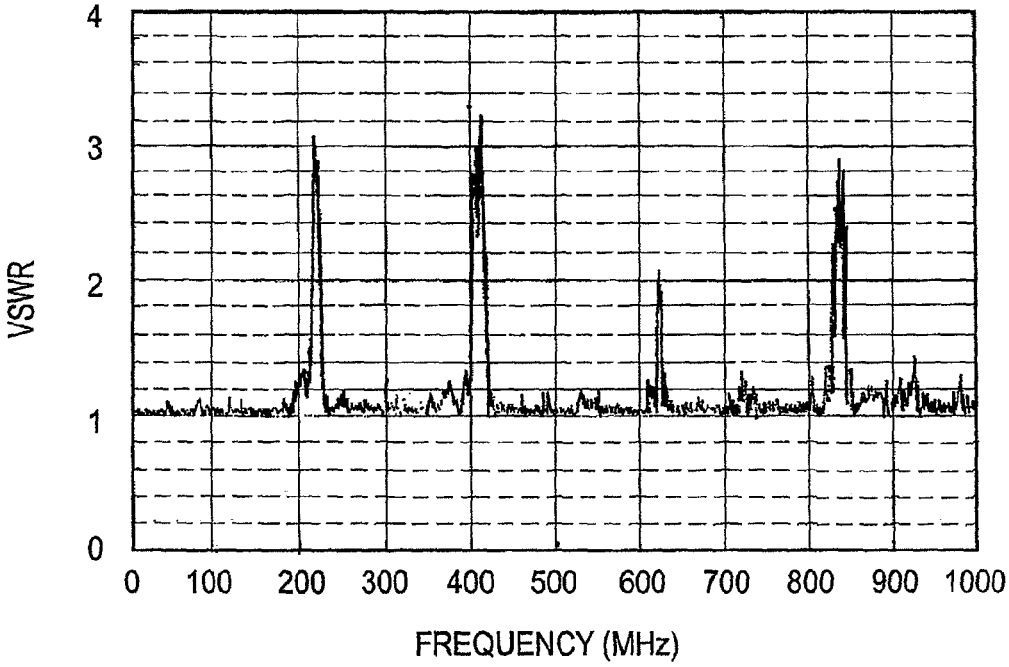
FIG. 17 CONVENTIONAL ART
FIG. 17 is a graph showing the frequency characteristic of the VSWR in a prototype of the conventional LCX.

A cable is manufactured by way of trial in accordance with the conventional design shown on Table 2. Then, a result of measurement of the VSWR with the cable manufactured by way of trial is shown in FIG. 17. As similar to the result of calculation in FIG. 14, a phenomenon of significant deterioration in the VSWR attributable to the resonance of the slots is generated at the frequencies of 210 MHz and the integral multiples thereof.

Meanwhile, a diagram on the right side in FIG. 14 shows radiation electric field distribution from the LCX in the range defined by a zone of 96 m in the cable length direction, 8 m away from the cable at the maximum, and the height of 1.5 m. It is apparent that the electric field strength remains stable in the cable length direction.

(2) Case of Sinusoidally Changing the Pitch Interval of Slot Units

Figure 15:
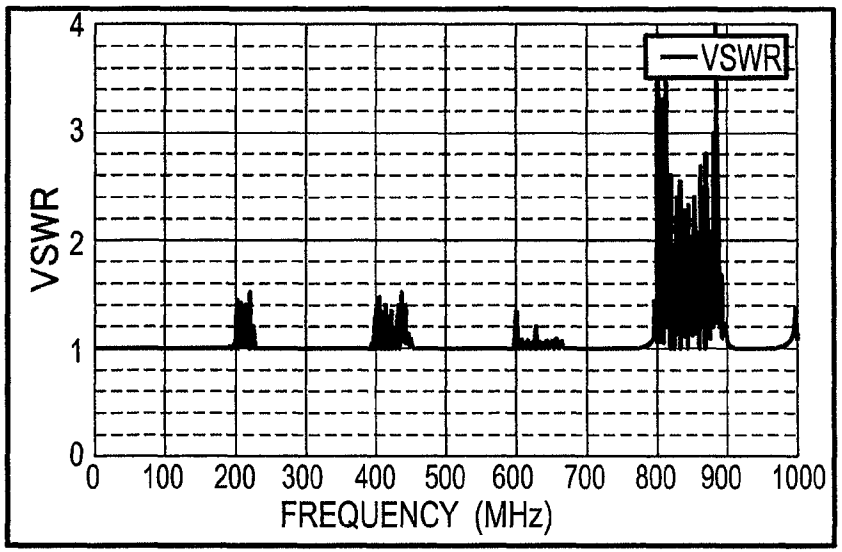
FIG. 15 is a graph showing the frequency characteristic of the VSWR in the LCX according to the present invention, the LCX having sinusoidally changing pitch interval of the slot units.
Figure 15:
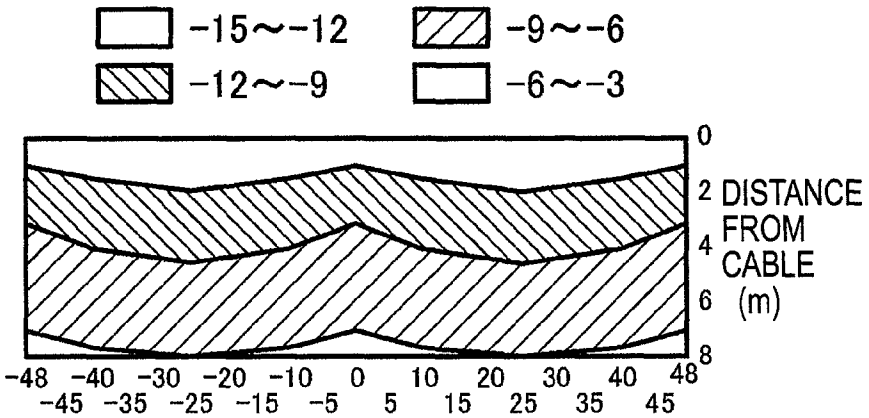

FIG. 15 is a graph showing the frequency characteristic of the VSWR in the LCX according to the present invention, the LCX having the sinusoidally changing pitch interval of the slot units.

FIG. 15 is obtained by calculating the VSWR based on this method. As for a change condition, a length of 50 m is defined as one unit and the pitch interval of the slot units is sinusoidally changed in this zone. Maximum positive and negative values of the amounts of variation are set to ±0.4 m. Meanwhile, the electric field distribution in the vicinity of the LCX in the similar range to the above-described section (1) is shown on a diagram on the right side in FIG. 15.

In this LCX, as shown in FIG. 15, a phenomenon of significant deterioration in the VSWR as observed in FIG. 14 is eliminated. It is apparent that the VSWR value remains low and dispersed. As a result, the LCX previously restricted for use while avoiding the resonance points can be used in a high frequency (which is equal to or higher than 1000 MHz in this case).

Figure 18:
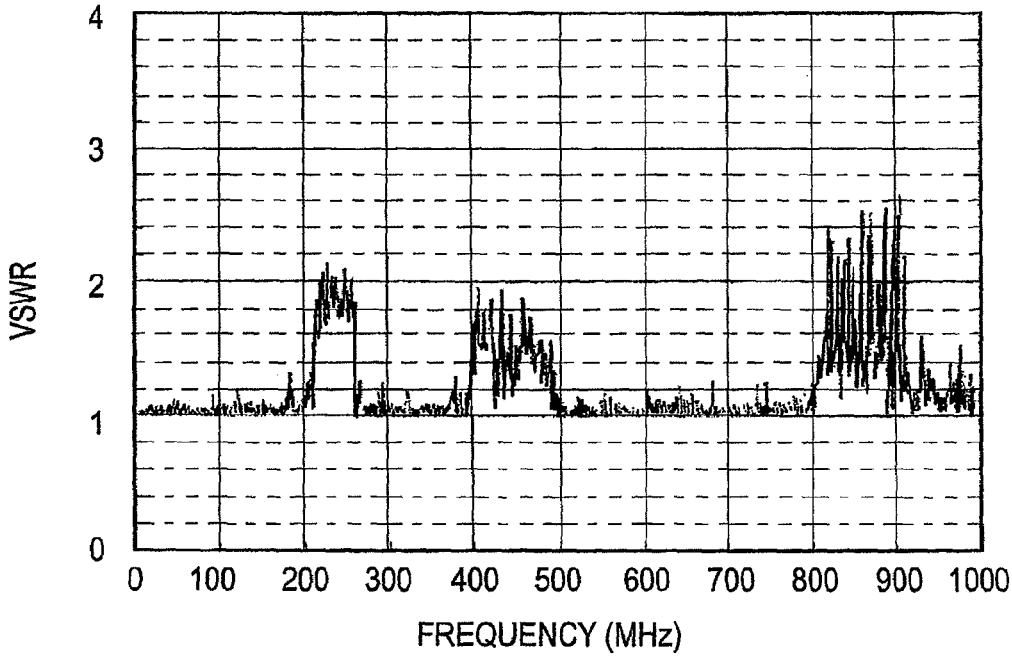
FIG. 18 is a graph showing the frequency characteristic of the VSWR in a prototype of an LCX according to embodiment 1 of the present invention.

A cable is manufactured by way of trial in order to confirm the result of calculation. The structure of the LCX is similar to that of the conventional design on Table 2 except the pitch interval of the slot units. The pitch interval of the slot units of the LCX manufactured by way of trial is sinusoidally changed starting from 1.25 m. As for a change condition, a length of 50 m is defined as one unit as similar to section (2) in embodiment 1 and the pitch interval of the slot units is sinusoidally changed in this zone. Maximum positive and negative values of the amounts of variation are set to ±0.4 m. A result of measurement of the VSWR is shown in FIG. 18. As similar to the result of calculation in FIG. 15, a decrease of significant deterioration in the VSWR as observed in FIG. 14 is eliminated. It is apparent that the VSWR value remains low and dispersed.

Moreover, from a diagram on the right side in FIG. 15, it is apparent that the electric field strength is slightly fluctuated.

Embodiment 2

(1) Case of Applying Quadratic Function to Pitch Change Function

Figure 16:
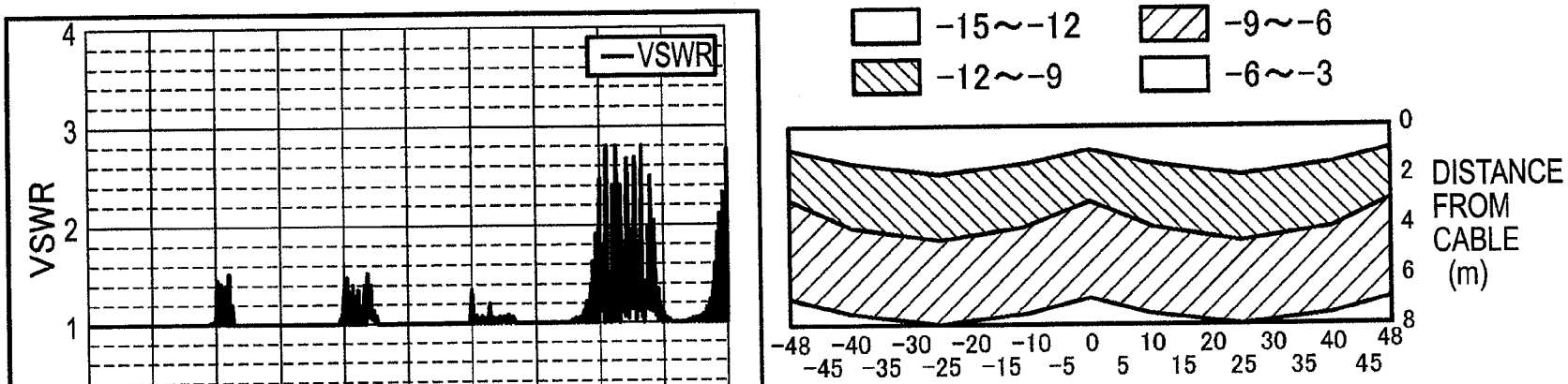
FIG. 16 is a graph showing the frequency characteristic of the VSWR in the LCX according to the present invention, the LCX having quadratically changing interval of the slot units.

FIG. 16 is a graph showing the frequency characteristic of the VSWR in the LCX according to the present invention, the LCX having quadratically changing interval of the slot units.

As for a change condition, a length of 50 m is defined as one unit as similar to section (2) in embodiment 1 and the pitch interval of the slot units is quadratically changed in this zone. Maximum positive and negative values of the amounts of variation are set to ±0.4 m. A result of calculation of the VSWR is shown in FIG. 16. Meanwhile, the electric field distribution in the vicinity of the LCX is shown on a diagram on the right side in FIG. 16. As apparent from comparing this FIG. 16 with FIG. 15, the phenomenon of the abrupt deterioration of the VSWR is obviously improved further in the frequency range around 800 MHz to 900 MHz in comparison with the case of the sinusoidal change shown in FIG. 15.

Figure 19:
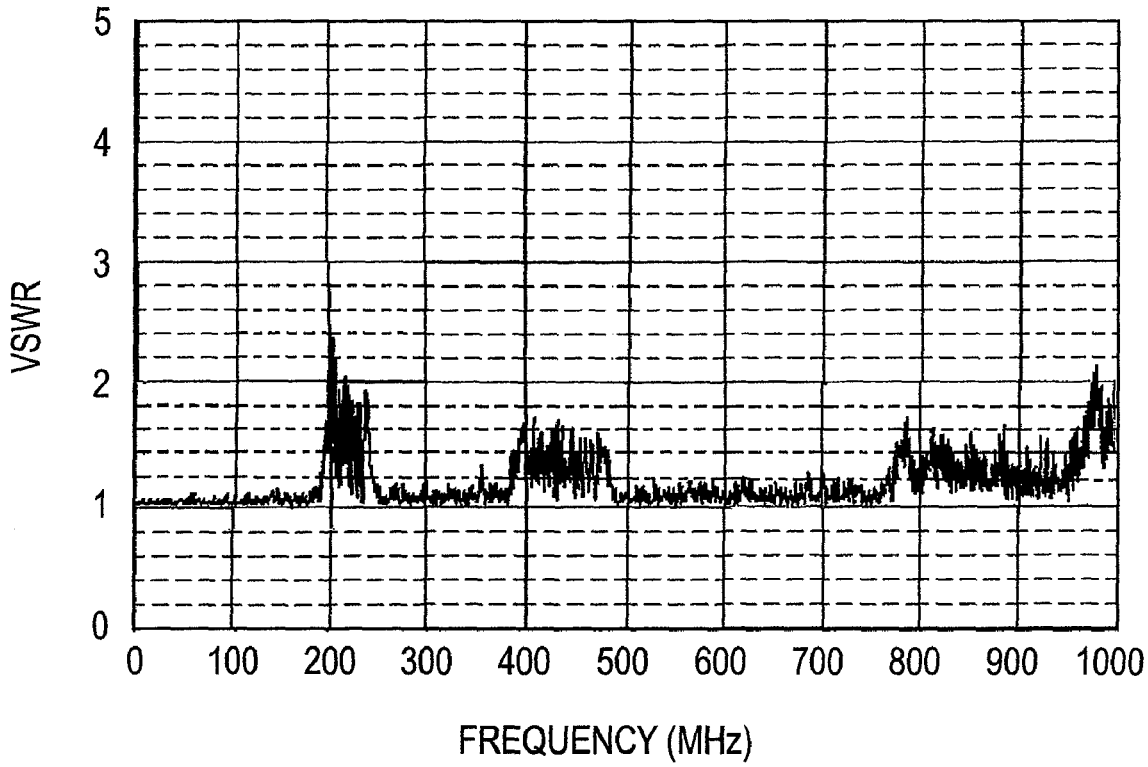
FIG. 19 is a graph showing the frequency characteristic of the VSWR in a prototype of an LCX according to embodiment 2 of the present invention.

A cable is actually manufactured by way of trial. The structure of the LCX is similar to the conventional design on Table 2 except the pitch interval of the slot units. The pitch interval of the slot units of the LCX manufactured by way of trial is changed starting from 1.25 m. As for a change condition, a length of 50 m is defined as one unit as similar to section (2) in embodiment 1 and the pitch interval of the slot units is quadratically changed in this zone. Maximum positive and negative values of the amounts of variation are set to ±0.4 m. A result of measurement of the VSRW is shown in FIG. 19. As similar to the result of calculation in FIG. 16, a decrease of significant deterioration in the VSWR as observed in FIG. 14 is eliminated. It is apparent that the VSWR value remains low and dispersed.

(2) Controlling Radiation Electric Field Strength in Cable Length Direction by Selection of Pitch Change Function From the result of calculation based on this method, it is apparent that the electric field distribution around the LCX is controllable by appropriately selecting the change function. Specifically, the electric field distribution around the LCX of the normal design is constant in the cable length direction as shown in FIG. 14. However, by changing the pitch interval of the slot units, it is possible to change the electric field strength in the cable length direction as shown in FIG. 15 or FIG. 16. Therefore, when there is size variation in space among cover areas of transmission and reception (such as a case of tracing a corridor, an open space, a corridor, an open space, and so on), it is possible to control the radiation electric field strength in conformity to the sizes of the space. Accordingly, it is possible to achieve stable transmission and reception across the entire coverage area.

Embodiment 3

(1) Nonresonant Cable

As shown in Formula (1.20) described above, it is possible to realize a nonresonant cable by raising the impedance of the cable with each passing slot, and thereby to obtain an ultra-broadband LCX. The method of raising the impedance includes measures of gradually thinning the central conductor, gradually reducing the dielectric constant of the insulator, gradually thickening the outer diameter of the insulator, and so forth.

(2) Increase in Radiation Power Using Multiple Slot Sequences

As shown in the above-described "Increase in radiation efficiency (arrangement of multiple slot units)", the directions of inclination of the slots are set up so that the directions are in the mutually opposite directions when the outer conductor is developed in the circumferential direction. As a result, the slots are aligned in the same direction in a perspective view from a radial direction on a line that passes the slots when the cable is formed. Hence it is possible to increase the radiation power. In this case, radiation becomes stronger on a plane intersecting the slots.

Therefore, it is possible to provide the LCX with a directional characteristic. In order to further enhance the radiation power, it is only necessary to increase the slots. Nevertheless, the slot arrangement method to maximize the radiation efficiency includes four sequences at an interval of 90°. The radiation efficiency is reduced when using more slot sequences.

(3) Increase in Radiation Power Using Multiple Slots

In order to enhance the radiation efficiency, the effective deflecting current may be increased in accordance with Formula (1.34). In this regard, it is possible to form the slots having more lengths as well as more width. However, excessive increases may result in a problem that the cable is apt to cause cracks on ends of the slots and to lose mechanical strength when bending force is applied to the cable or tension is applied thereto. Nevertheless, as shown in FIG. 10 described above, it is possible to enhance the radiation efficiency without deteriorating the mechanical strength by using numerous small slots.

INDUSTRIAL APPLICABILITY

In a leaky coaxial cable including slot units including multiple slots for forming a leak electromagnetic field formed sequentially in an outer conductor of the coaxial cable, the pitch interval between the respective slot units is periodically changed in the axial direction. This periodical change is in accordance with a sine function, a quadratic function or other functions.

In this way, it is possible to eliminate a resonant state of the electromagnetic field that may occur in the case of arranging the slot units at a constant pitch interval. Accordingly, it is possible to widen a usable frequency band.

The invention claimed is:

1. A leaky coaxial cable including a plurality of slot portions for forming a leaky electromagnetic field, the plurality of slot portions being arranged in an array in an outer conductor of the leaky coaxial cable, characterized in that each of the plurality of slot portions defined by a set of a plurality of slots arranged in an axial direction, and pitch intervals of the plurality of slot portions is periodically changed in the axial direction.

2. The leaky coaxial cable according to claim 1, wherein the pitch intervals of the plurality of slot portions are changed in accordance with a sine function.

3. The leaky coaxial cable according to claim 1, wherein the pitch intervals of the plurality of slot portions are changed in accordance with a quadratic function.

4. The leaky coaxial cable according to claim 1, wherein the plurality of slot portions form a plurality of slot sequences in the outer conductor, are provided on the opposite sides of a cable axis from each other in the same position relative to the axial direction, and have the directions of inclination relative to the axial direction equal to one another.

5. The leaky coaxial cable according to claim 1, wherein each of the plurality of slot portions provided in the outer conductor includes numerous small slots equivalent to a large slot.

* * * * *